US012104296B2

(12) United States Patent
Ogata et al.

(10) Patent No.: US 12,104,296 B2
(45) Date of Patent: Oct. 1, 2024

(54) KNITTED FABRIC WITH FLAPS, AND FIBER PRODUCT

(71) Applicant: TEIJIN FRONTIER CO., LTD., Osaka (JP)

(72) Inventors: Nobuaki Ogata, Osaka (JP); Takanori Harage, Osaka (JP); Sonomi Shibata, Osaka (JP)

(73) Assignee: TEIJIN FRONTIER CO., LTD., Osaka (JP)

( * ) Notice: Subject to any disclaimer, the term of this patent is extended or adjusted under 35 U.S.C. 154(b) by 759 days.

(21) Appl. No.: 17/045,556

(22) PCT Filed: Apr. 3, 2019

(86) PCT No.: PCT/JP2019/014818
§ 371 (c)(1),
(2) Date: Oct. 6, 2020

(87) PCT Pub. No.: WO2019/202993
PCT Pub. Date: Oct. 24, 2019

(65) Prior Publication Data

US 2021/0156057 A1 May 27, 2021

(30) Foreign Application Priority Data

Apr. 16, 2018 (JP) ..... 2018-078317

(51) Int. Cl.
*D04B 1/22* (2006.01)
*A41D 31/02* (2019.01)
(Continued)

(52) U.S. Cl.
CPC ..... *D04B 1/22* (2013.01); *A41D 31/02* (2013.01); *A41D 31/145* (2019.02); *D01F 8/12* (2013.01);
(Continued)

(58) Field of Classification Search
CPC ... D04B 1/22; D04B 1/16; D04B 1/24; D04B 1/26; D04B 1/28; A41D 31/02;
(Continued)

(56) References Cited

U.S. PATENT DOCUMENTS

2005/0204449 A1* 9/2005 Baron ..... D03D 15/49 2/69
2007/0270067 A1* 11/2007 Yasui ..... D04B 1/16 442/308
(Continued)

FOREIGN PATENT DOCUMENTS

CN 101031679 A 9/2007
CN 101039598 A 9/2007
(Continued)

OTHER PUBLICATIONS

Machine Translation of JPS5751871 A. (Year: 1982).*
(Continued)

*Primary Examiner* — Brian Handville
(74) *Attorney, Agent, or Firm* — Sughrue Mion, PLLC

(57) ABSTRACT

The invention addresses the problem of providing a flap-equipped knitted fabric including a flap part, which is configured such that the flap part moves when wet, allowing for changes in the air permeability or appearance of the flap-equipped knitted fabric, and also a textile product. As a means for resolution, for example, in a flap-equipped knitted fabric including a ground structure part and a flap part, the flap part is pouch-shaped, and the flap part contains a conjugate fiber obtained by joining a polyester component and a polyamide component in a side-by-side manner or an eccentric sheath-core manner, thereby making the flap part movable upon wetting.

11 Claims, 3 Drawing Sheets

(51) Int. Cl.

| | |
|---|---|
| ***A41D 31/14*** | (2019.01) |
| ***D01F 8/12*** | (2006.01) |
| ***D01F 8/14*** | (2006.01) |
| ***D04B 1/16*** | (2006.01) |

(52) U.S. Cl.
CPC ..... *D01F 8/14* (2013.01); *D04B 1/16* (2013.01); *A41D 2500/10* (2013.01)

(58) Field of Classification Search
CPC ..... A41D 31/145; A41D 2500/10; A41D 27/285; A41D 31/00; D01F 8/12; D10B 2401/02; D10B 2403/0113; D01D 5/32; D01D 5/34; D02G 3/286
See application file for complete search history.

(56) References Cited

U.S. PATENT DOCUMENTS

| | | | | |
|---|---|---|---|---|
| 2008/0132133 | A1 | 6/2008 | Yasui et al. | |
| 2009/0308107 | A1* | 12/2009 | Ogata ..... | D04B 1/16 66/171 |
| 2015/0050438 | A1 | 2/2015 | Ogata et al. | |
| 2015/0361599 | A1 | 12/2015 | Minor | |
| 2018/0142384 | A1 | 5/2018 | Ogata | |

FOREIGN PATENT DOCUMENTS

| | | | |
|---|---|---|---|
| CN | 101044274 | A | 9/2007 |
| CN | 101128313 | A | 2/2008 |
| CN | 101479416 | A | 7/2009 |
| CN | 102691162 | A | 9/2012 |
| CN | 104480622 | A | 4/2015 |
| CN | 106136452 | A | 11/2016 |
| CN | 106715772 | A | 5/2017 |
| JP | 57-51871 | A | 3/1982 |
| JP | 59-223343 | A | 12/1984 |
| JP | 62-12341 | B2 | 3/1987 |
| JP | 03-17944 | B2 | 3/1991 |
| JP | 06-316844 | A | 11/1994 |
| JP | 2006-97147 | A | 4/2006 |
| JP | 2008-517183 | A | 5/2008 |
| JP | 2011-144487 | A | 7/2011 |
| TW | 200615412 | A | 5/2006 |
| TW | I623660 | B | 5/2018 |
| WO | 2008/001920 | A1 | 1/2008 |
| WO | 2017/038239 | A1 | 3/2017 |

OTHER PUBLICATIONS

Machine Translation of CN 101031679 A (Year: 2007).*
International Preliminary Report on Patentability with the translation of Written Opinion dated Oct. 20, 2020 from the International Bureau in International Application No. PCT/JP2019/014818.
Office Action dated May 7, 2021 from the China National Intellectual Property Administration in CN Application No. 201980025801.4.
International Search Report of PCT/JP2019/014818 dated Jun. 18, 2019.
Office Action issued Sep. 9, 2021 in Chinese Application No. 201980025801.4.
Office Action issued Oct. 26, 2021 in Japanese Application No. 2020-514070.
Communication dated Aug. 17, 2023, issued in Korean Application No. 10-2020-7032406.

* cited by examiner

[Fig. 1]

| X: Cylinder Knit | | | | |
|---|---|---|---|---|
| Yarn Type | Structure | | | |
| A | 1 | X | X | Ground structure part (G) |
| A | 2 | X | X | |
| A | 3 | X | X | |
| A | 4 | X | X | |
| A | 5 | X | | Flap part (P) |
| A | 6 | X | | |
| B | 7 | X | | |
| B | 8 | X | | |
| B | 9 | X | | |
| B | 10 | X | | |
| B | 11 | X | | |
| B | 12 | X | | |
| B | 13 | X | | |
| B | 14 | X | | |
| B | 15 | X | | |
| B | 16 | X | | |
| B | 17 | X | | |
| B | 18 | X | | |
| B | 19 | X | | |
| B | 20 | X | | |
| A | 21 | X | | |
| A | 22 | X | | |
| A | 23 | X | | |
| A | 24 | X | | |
| A | 25 | X | | |
| A | 26 | X | | |
| A | 27 | X | | |
| A | 28 | X | | |
| A | 29 | X | | |
| A | 30 | X | | |
| A | 31 | X | | |
| A | 32 | X | | |
| A | 33 | X | | |
| A | 34 | X | | |
| A | 35 | X | | |
| A | 36 | X | | |

[Fig. 2]

| X: Cylinder Knit | | | | |
|---|---|---|---|---|
| Yarn Type | Structure | | | |
| A | 1 | X | X | Ground structure part (G) |
| A | 2 | X | X | |
| A | 3 | X | X | |
| A | 4 | X | X | |
| A | 5 | X | | Flap part (P) |
| A | 6 | X | | |
| A | 7 | X | | |
| A | 8 | X | | |
| A | 9 | X | | |
| A | 10 | X | | |
| A | 11 | X | | |
| A | 12 | X | | |
| A | 13 | X | | |
| A | 14 | X | | |
| A | 15 | X | | |
| A | 16 | X | | |
| A | 17 | X | | |
| A | 18 | X | | |
| A | 19 | X | | |
| A | 20 | X | | |
| A | 21 | X | | |
| A | 22 | X | | |
| A | 23 | X | | |
| A | 24 | X | | |
| A | 25 | X | | |
| A | 26 | X | | |
| A | 27 | X | | |
| A | 28 | X | | |
| A | 29 | X | | |
| A | 30 | X | | |
| A | 31 | X | | |
| A | 32 | X | | |
| A | 33 | X | | |
| A | 34 | X | | |
| A | 35 | X | | |
| A | 36 | X | | |

[FIG. 3]
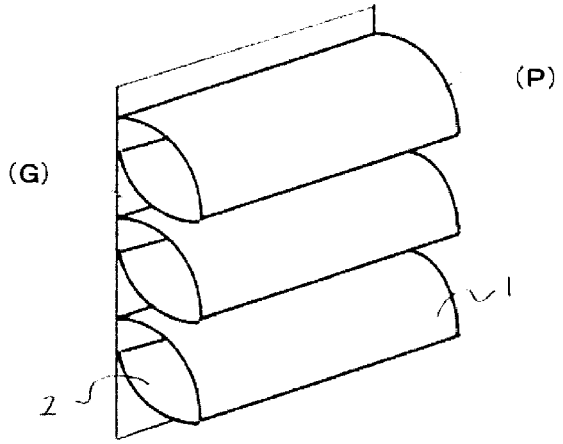
[FIG. 4]
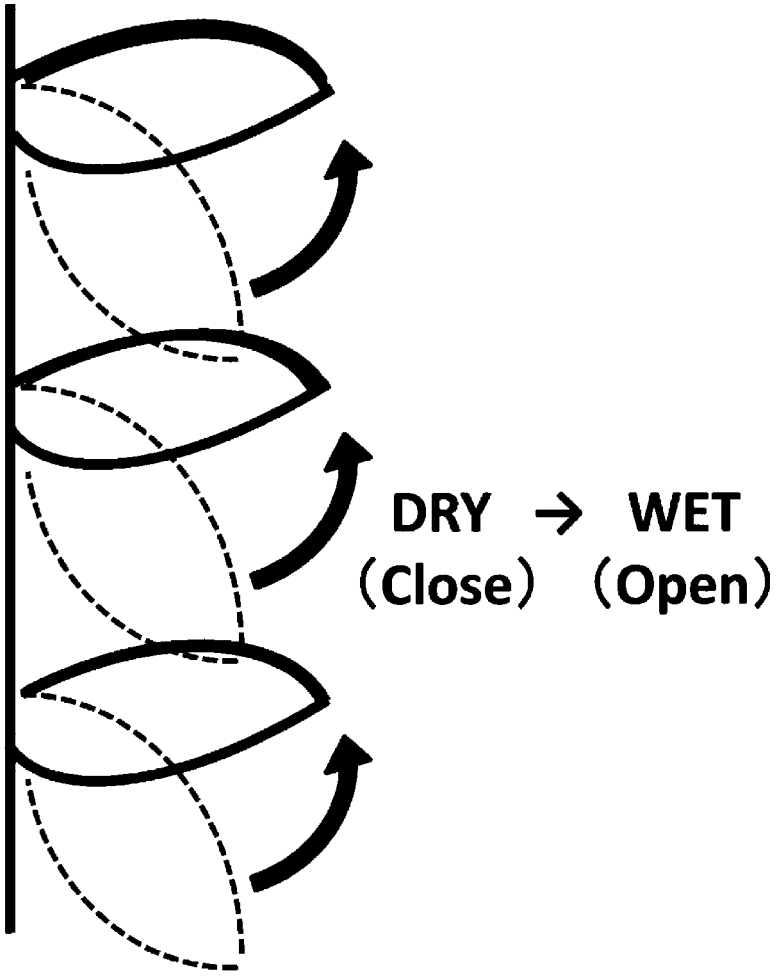

KNITTED FABRIC WITH FLAPS, AND FIBER PRODUCT

CROSS REFERENCE TO RELATED APPLICATIONS

This application is a National Stage of International Application No. PCT/JP2019/014818, filed Apr. 3, 2019, claiming priority to Japanese Patent Application No. 2018-078317, filed Apr. 16, 2018.

TECHNICAL FIELD

The present invention relates to a flap-equipped knitted fabric including a flap part, which is configured such that the flap part moves when wet, allowing for changes in the air permeability or appearance of the flap-equipped knitted fabric, and also to a textile product.

BACKGROUND ART

Conventionally, a flap-equipped knitted fabric having a plurality of flap parts (fold parts) has been proposed (e.g., PTLs 1, 2, and 3). Because of the plurality of flap parts, such a flap-equipped knitted fabric has excellent heat-shielding properties or heat-insulating properties.

However, there has been no conventional flap-equipped knitted fabric whose flap parts move when wet.

CITATION LIST

Patent Literature

PTL 1: JP-B-62-12341
PTL 2: JP-B-3-17944
PTL 3: JP-A-6-316844

SUMMARY OF INVENTION

Technical Problem

The invention has been accomplished against the above background. An object thereof is to provide a flap-equipped knitted fabric including a flap part, which is configured such that the flap part moves when wet, allowing for changes in the air permeability or appearance of the flap-equipped knitted fabric, and also a textile product.

Solution to Problem

The present inventors have conducted extensive research to solve the above problems and, as a result, found that in a flap-equipped knitted fabric including a flap part, when fibers that form the flap part, for example, are tailored with ingenuity, it becomes possible to make the flap part movable when wet. As a result of further extensive research, they have accomplished the invention.

Thus, the invention provides "a flap-equipped knitted fabric including a ground structure part and a flap part, wherein the flap part is movable upon wetting."

In this case, it is preferable that the flap part is pouch-shaped. In addition, it is preferable that the flap part contains a conjugate fiber obtained by joining a polyester component and a polyamide component in a side-by-side manner or an eccentric sheath-core manner. In addition, it is preferable that the flap part contains a false-twist crimped yarn. In particular, it is preferable that the false-twist crimped yarn is contained in the flap part as a constituent yarn of a composite yarn having a torque of 30 T/m or less. In addition, it is preferable that a false-twist crimped yarn having a torque in the S-direction and a false-twist crimped yarn having a torque in the Z-direction are alternately disposed. In addition, it is preferable that the flap part contains a water-repellent yarn. In addition, it is preferable that the flap-equipped knitted fabric is a circular-knitted fabric. In addition, it is preferable that the flap-equipped knitted fabric changes in air permeability and/or appearance when wet.

In addition, the invention provides a textile product, which is selected from the group consisting of sportswear, outerwear, innerwear, men's clothing, women's clothing, medical clothing, nursing clothing, lining fabrics, summer kimono, workwear, protective clothing, footwear, hats, gloves, socks, masks, bedding, curtains, bedding covers, and chair covers, including the above flap-equipped knitted fabric.

Advantageous Effects of Invention

The invention enables the provision of a flap-equipped knitted fabric including a flap part, which is configured such that the flap part moves when wet, allowing for changes in the air permeability or appearance of the flap-equipped knitted fabric, and also a textile product.

BRIEF DESCRIPTION OF DRAWINGS

FIG. 1 is the knitting pattern used in Example 1.

FIG. 2 is the knitting pattern used in Comparative Example 1.

FIG. 3 schematically shows the flap-equipped knitted fabric of the invention.

FIG. 4 schematically shows how flap parts move when wet (cross-sectional view).

DESCRIPTION OF EMBODIMENTS

Hereinafter, embodiments of the invention will be described in detail. The flap-equipped knitted fabric of the invention includes a ground structure part and a flap part, and the flap part is movable upon wetting. As schematically shown in FIG. 4, upon wetting, the end portion of the flap part moves away from the ground structure part.

Here, when the flap part is pouch-shaped as shown in FIG. 3, the heat-shielding properties and heat-insulating properties are improved, and, in addition to this, the yarn configuration can be changed between the atmospheric side and the ground structure part side of the flap part; therefore, this is preferable.

In addition, it is preferable that the flap part contains a conjugate fiber obtained by joining a polyester component and a polyamide component in a side-by-side manner or an eccentric sheath-core manner. In particular, when the flap part is pouch-shaped, and also such a conjugate fiber is disposed on the ground structure part side of the flap part, the apparent length of the conjugate fiber increases when wet. As a result, the end portion of the flap part moves further away from the ground structure part.

As the conjugate fiber, the conjugate fiber obtained by joining a polyester component and a polyamide component in a side-by-side manner or an eccentric sheath-core manner described in JP-A-2006-97147 is suitable.

That is, as the polyester component, in terms of adhesion to the other polyamide component, modified polyesters, such as polyethylene terephthalate, polypropylene terephthalate, and polybutylene terephthalate having an alkali or alkaline-earth metal of sulfonic acid or a phosphonium salt and copolymerized with a compound having at least one ester-forming functional group, are preferable. Among them, in terms of versatility and polymer cost, a modified polyethylene terephthalate copolymerized with the above compound is particularly preferable. Examples of copolymerization components in this case include 5-sodium sulfoisophthalic acid and ester derivatives thereof, 5-phosphonium isophthalic acid and ester derivatives thereof, and sodium p-hydroxybenzenesulfonate. Among them, 5-sodium sulfoisophthalic acid is preferable. The amount of copolymerization is preferably within a range of 2.0 to 4.5 mol %. When the amount of copolymerization is less than 2.0 mol %, although excellent crimping is obtained, delamination may occur at the joining interface between the polyamide component and the polyester component. Conversely, when the amount of copolymerization is more than 4.5 mol %, at the time of a stretching heat treatment, crystallization of the polyester component is less likely to proceed. Accordingly, the stretching heat treatment temperature has to be increased, possibly resulting in frequent yarn breakage.

Meanwhile, the polyamide component is not particularly limited as long as it has an amide bond in the main chain, and examples thereof include Nylon 4, Nylon 6, Nylon 66, Nylon 46, and Nylon 12. Among them, in terms of versatility, polymer cost, and yarn-making stability, Nylon 6 and Nylon 66 are suitable.

Incidentally, the polyester component and the polyamide component may also contain known additives, such as pigments, delusterants, antifoulants, fluorescent brighteners, flame retardants, stabilizers, antistatic agents, light stabilizers, and UV absorbers.

The conjugate fiber may have any cross-sectional shape and conjugation form, and may also be an eccentric sheath-core fiber. Further, the fiber may also be triangular or quadrilateral or have a hollow portion in the cross-section. The conjugation ratio between the two components can be arbitrarily selected, but it is usually preferable that the weight ratio between the polyester component and the polyamide component is within a range of 30:70 to 70:30 (more preferably 40:60 to 60:40).

The conjugate fiber is preferably in the form of a long fiber (multifilament). In this case, the single fiber fineness or the number of single fibers (number of filaments) is not particularly limited. However, it is preferable that the single fiber fineness is within a range of 1 to 10 dtex (more preferably 2 to 5 dtex), and the number of single fibers is within a range of 10 to 200 (more preferably 20 to 100).

In addition, it is preferable that the conjugate fiber has a crimped structure resulting from the development of latent crimp. A conjugate fiber composed of different kinds of polymers joined in a side-by-side manner usually has latent crimp and, as described below, develops the latent crimp when heat-treated during dyeing or the like. As the crimped structure, it is preferable that the polyamide component is located on the inner side of the crimp, and the polyester component is located on the outer side of the crimp. A conjugate fiber having such a crimped structure can be easily obtained by the production method described in JP-A-2006-97147. In the case where a conjugate fiber has such a crimped structure, when wet, the inner polyamide component swells and expands, while the outer polyester component hardly changes in length; as a result, the crimp degree decreases (the apparent length of the conjugate fiber increases). Meanwhile, when dry, the inner polyamide component shrinks, while the outer polyester component hardly changes in length; as a result, the crimp degree increases (the apparent length of the conjugate fiber decreases).

In order for the crimp to easily decrease when wet, whereby breathability improves with good performance, it is preferable that the conjugate fiber is a zero-twist yarn or a loose-twist yarn twisted at 300 T/m or less. A zero-twist yarn is particularly preferable. When the fiber is strongly twisted like a hard-twist yarn, crimp is difficult to decrease when wet, which is undesirable. Incidentally, it is also acceptable that the fiber has been subjected to air interlacing in such a manner that the number of entanglements is about 20 to 200/m (preferably 20 to 60/m) and/or to ordinary false-twist crimping.

In addition, it is preferable that the flap part contains a false-twist crimped yarn. In particular, when the false-twist crimped yarn is contained in the flap part as a composite yarn having a torque of 30 T/m or less, face stabilization, snagging resistance, heat-shielding properties, heat-insulating properties, and the like improve; therefore, this is preferable. It is preferable that the flap part is pouch-shaped, and such a composite yarn is disposed on the atmospheric side of the flap part.

As such a composite yarn, the composite yarn described in WO 2008/001920, for example, is preferable.

That is, it is a composite yarn composed of two or more kinds of false-twist crimped yarns different from each other in terms of production conditions or fineness. False-twist crimped yarns include a so-called one-heater false-twist crimped yarn obtained by setting false twists in a first heater zone and a so-called second-heater false-twist crimped yarn obtained by further introducing the yarn into a second heater zone and subjecting the same to a relaxation heat treatment to reduce the torque. In addition, depending on the direction of twisting, there exist a false-twist crimped yarn having a torque in the S-direction and a false-twist crimped yarn having a torque in the Z-direction. In the invention, these false-twist crimped yarns can be used. In particular, when a false-twist crimped yarn having a torque in the S-direction and a false-twist crimped yarn having a torque in the Z-direction are used to form a composite yarn, a low-torque composite yarn can be obtained; therefore, this is preferable.

The composite yarn described above can be produced by the following method, for example. That is, it is possible that a yarn is twisted using a twisting apparatus through a first roller and a heat treatment heater at a set temperature of 90 to 220° C. (more preferably 100 to 190° C.), thereby giving a one-heater false-twist crimped yarn. Alternatively, as necessary, it is also possible that the yarn is further introduced into a second heater zone and subjected to a relaxation heat treatment, thereby giving a second-heater false-twist crimped yarn. The draw ratio during false-twist texturing is preferably within a range of 0.8 to 1.6. The number of false twists is preferably such that $\alpha$=0.5 to 1.5, usually about 0.8 to 1.2, in the following equation: the number of false twists $(T/m)=(32500/(Dtex)^{1/2})\times\alpha$. Here, Dtex is the total fineness of the yarn. As the twisting apparatus used, a disk-type or belt-type friction twisting apparatus, which allows for easy threading and hardly causes yarn breakage, is preferable. However, it is also possible to use a pin-type twisting apparatus. In addition, depending on the direction of twisting, the torque of the false-twist crimped yarn can be selected from the S-direction and the Z-direction. Next, two or more kinds of false-twist crimped yarns are combined, whereby the composite yarn described above can be obtained.

It is preferable that the composite yarn has been entangled by interlacing. In order not to impair the soft texture or stretchability, it is preferable that the number of entanglements (interlaces) is within a range of 30 to 200/m. When the number is more than 200/m, the soft texture or stretchability may be impaired. Conversely, when the number is less than 30/m, the bundling properties of the composite yarn may be insufficient, impairing the knitting properties. Incidentally, the entanglement treatment (interlacing) may be a treatment using an ordinary interlacing nozzle.

It is preferable that the composite yarn thus obtained has a torque of 30 T/m or less (more preferably 10 T/m or less, and particularly preferably no torque (0 T/m)). When such a low-torque composite yarn is used to form a knitted fabric, excellent snagging resistance can be obtained without impairing the soft texture or stretchability. A lower torque is more preferable, and non-torque (0 T/m) is the most preferable. In order to achieve such non-torque, it is suitable that when combining a false-twist crimped yarn having a torque in the S-direction and a false-twist crimped yarn having a torque in the Z-direction, two kinds of false-twist crimped yarns having the same torque except for the torque direction are used.

In addition, in the composite yarn, it is preferable that the crimp degree is 2% or more (more preferably 10 to 200). When the crimp degree is less than 2%, a sufficient soft texture or stretchability may not be obtained.

In the composite yarn, it is preferable that the single fiber fineness is 4 dtex or less (preferably 0.00002 to 2.0 dtex, and particularly preferably 0.1 to 2.0 dtex). Lower single fiber fineness is more preferable, and it is also possible to use a yarn having a single fiber diameter of 1,000 nm or less, which is so-called "nanofiber". When the single fiber fineness is more than 4 dtex, a soft texture may not be obtained. In addition, it is preferable that the total fineness of the composite yarn is within a range of 33 to 220 dtex. Further, it is preferable that the number of filaments in the composite yarn is within a range of 50 to 300 (more preferably 100 to 300).

In addition, as the single fiber cross-sectional shape of the fiber that forms the composite yarn, although an ordinary round cross-section is possible, modified cross-sectional shapes other than the round cross-section are also possible. Such a modified cross-sectional shape may be triangular, quadrilateral, cross-shaped, flat, flat with constrictions, H-shaped, W-shaped, or the like, for example. When these modified cross-sectional shapes are employed, water-absorbing properties can be imparted to the knitted fabric.

Fibers to form the composite yarn are not particularly limited, and polyester fibers, acrylic fibers, nylon fibers, rayon fibers, and acetate fibers, as well as natural fibers such as cotton, wool, and silk, and combinations thereof can be used. Polyester fibers are particularly preferable. As such polyesters, polyesters in which the main acid component is terephthalic acid, and the main glycol component is at least one member selected from the group consisting of $C_{2-6}$ alkylene glycols, that is, ethylene glycol, trimethylene glycol, tetramethylene glycol, pentamethylene glycol, and hexamethylene glycol, are preferable. Among them, a polyester whose main glycol component is ethylene glycol (polyethylene terephthalate) and a polyester whose main glycol component is trimethylene glycol (polytrimethylene terephthalate) are particularly preferable.

Such a polyester may contain a small amount of a copolymer component (usually 30 mol % or less) as necessary. As bifunctional carboxylic acids other than terephthalic acid used in this case, for example, aromatic, aliphatic, and alicyclic bifunctional carboxylic acids such as isophthalic acid, naphthalenedicarboxylic acid, diphenyldicarboxylic acid, diphenoxyethanedicarboxylic acid, β-hydroxyethoxybenzoic acid, p-oxybenzoic acid, 5-sodium sulfoisophthalic acid, adipic acid, sebacic acid, and 1,4-cyclohexanedicarboxylic acid can be mentioned. In addition, as diol compounds other than the above glycols, for examples, aliphatic, alicyclic, and aromatic diol compounds such as cyclohexane-1,4-dimethanol, neopentyl glycol, bisphenol A, and bisphenol S, as well as polyoxyalkylene glycols, can be mentioned.

The polyester may be synthesized by any method. For example, in the case of polyethylene terephthalate, it may be produced through a first-stage reaction in which terephthalic acid and ethylene glycol are directly subjected to an esterification reaction, a lower alkyl ester of terephthalic acid (e.g., dimethyl terephthalate) and ethylene glycol are subjected to a transesterification reaction, or terephthalic acid and ethylene oxide are allowed to react, thereby producing a glycol ester of terephthalic acid and/or an oligomer thereof, and a second-stage reaction in which the product of the first-stage reaction is heated under reduced pressure to cause a polycondensation reaction until the desired degree of polymerization is reached. In addition, the polyester may also be a material-recycled or chemically recycled polyester, or alternatively a polyester obtained using a catalyst containing a specific phosphorus compound or titanium compound as described in JP-A-2004-270097 and JP-A-2004-211268. Further, the polyester may also be a biodegradable polyester, such as polylactic acid or stereocomplex polylactic acid.

When the polyester contains a UV absorber in an amount of 0.1 wt % or more (preferably 0.1 to 5.0 wt %) relative to the polyester weight, UV-shielding properties are imparted to the knitted fabric; therefore, this is preferable. Examples of such UV absorbers include benzoxazine-based organic UV absorbers, benzophenone-based organic UV absorbers, benzotriazole-based organic UV absorbers, and salicylic acid-based organic UV absorbers. Among them, benzoxazine-based organic UV absorbers are particularly preferable because they do not decompose at the stage of spinning.

As such benzoxazine-based organic UV absorbers, those disclosed in JP-A-62-11744, that is, 2-methyl-3,1-benzoxazin-4-one, 2-butyl-3,1-benzoxazin-4-one, 2-phenyl-3,1-benzoxazin-4-one, 2,2'-ethylenebis(3,1-benzoxazin-4-one), 2,2'-tetramethylenebis(3,1-benzoxazin-4-one), 2,2'-p-phenylenebis(3,1-benzoxazin-4-one), 1,3,5-tri(3,1-benzoxazin-4-on-2-yl)benzene, 1,3,5-tri(3,1-benzoxazin-4-on-2-yl) naphthalene, and the like, are suitable, for example.

In addition, when the polyester contains a delusterant (titanium dioxide) in an amount of 0.2 wt % or more (preferably 0.3 to 2.0 wt %) relative to the polyester weight, anti-see-through properties are imparted to the knitted fabric; therefore, this is preferable.

Further, as necessary, the polyester may also contain one or more kinds of micropore-forming agents (metal organosulfonates), coloring inhibitors, heat stabilizers, flame retardants (diantimony trioxide), fluorescent brighteners, coloring pigments, antistatic agents (metal sulfonates), moisture absorbers (polyoxyalkylene glycols), antibacterial agents, and other inorganic particles.

In addition, as described above, in the flap part (preferably on the atmospheric side of the flap part), when a composite yarn having a torque of 30 T/m or less is disposed, or a false-twist crimped yarn having a torque in the S-direction and a false-twist crimped yarn having a torque in the Z-direction are alternately disposed, face stabilization and snagging resistance improve; therefore, this is preferable. In this case, one false-twist crimped yarn having a torque in the S-direction may be alternated with one false-twist crimped yarn having a torque in the Z-direction, and it is also possible that a plurality of yarns are alternated with a plurality of yarns, or one yarn is alternated with a plurality of yarns.

In addition, it is preferable that the flap part contains a water-repellent yarn. In this case, as the water-repellent yarn, a water-repellent polyester fiber, polypropylene fiber, polyethylene fiber, polyvinyl chloride fiber, or the like is suitable.

Here, the water-repellent polyester fiber is preferably a polyester fiber copolymerized or blended with a silicone-based compound, a fluorine-based compound, or a hydrocarbon-based compound or a polyester fiber subjected to water repellent processing using a silicone, hydrocarbon, or fluorine-based water repellent agent. In this case, it is preferable that the amount of copolymerization or blending is 5 to 25 wt % relative to the polyester weight. In addition, in a polyester fiber subjected to water repellent processing, it is preferable that the water repellent agent content is 0.4 wt % or more (more preferably 0.4 to 10 wt %) relative to the polyester fiber weight before processing.

In this case, it is preferable that the fluorine-based water repellent agent is a fluorine-based water repellent agent containing perfluorooctanoic acid and perfluorooctanesulfonic acid at a total concentration of 5 ng/g or less (preferably 0 ng/g). Examples of such fluorine-based water repellent agents include perfluoroalkyl-acrylate copolymers composed only of monomers having no N-methylol group and commercially available products. Preferred examples of commercially available products include a fluorine-based water/oil repellent agent AsahiGuard E-SERIES AG-E061 manufactured by Asahi Glass Co., Ltd., and SCOTCHGARD PM3622, PM490, and PM930 manufactured by Sumitomo 3M Limited.

Incidentally, the method for producing the water-repellent polyester fiber is not particularly limited and may be a known method. The method for producing a polyester fiber copolymerized or blended with a silicone-based compound or a fluorine-based compound may be, for example, the method described in JP-A-2010-138507. Meanwhile, the method of water repellent processing may be, for example, a method in which a fluorine-based water repellent agent is mixed as necessary with an antistatic agent, a melamine resin, a catalyst, etc., and the resulting processing agent is applied to a polyester fiber by padding, spraying, or the like.

Here, as the method for subjecting a polyester fiber to water repellent processing, rather than performing water repellent processing in the cloth stage, it is more preferable to perform water repellent processing in the fiber stage. In the case where water repellent processing is performed in the fiber stage, as compared with the case of water repellent processing in the cloth stage, individual fibers are coated with the water repellent agent, whereby the total coated area increases, and the durability of water repellency is improved; therefore, this is preferable.

The water-repellent yarn may be in the form of a short fiber (spun yarn) or a long fiber (multifilament). In particular, it is preferable that the single fiber fineness is 1.0 to 5.0 dtex (more preferably 1.5 to 3.0 dtex). With respect to the number of filaments and the total fineness of the water-repellent yarn, it is preferable that the number of filaments is 20 or more (more preferably 20 to 200), and the total fineness is 30 to 200 dtex (more preferably 30 to 150 dtex).

The flap-equipped knitted fabric of the invention can be produced using the above yarn by, for example, the method described in JP-B-62-12341, JP-B-3-17944, JP-A-6-316844, or the like. In this case, knitting is preferably performed using a single circular knitting machine (preferably over 28 gauge, particularly preferably 28 to 80 gauge).

In the flap-equipped knitted fabric thus obtained, it is preferable that the weight per unit is within a range of 100 to 300 g/m$^2$.

In addition, the fabric may also be subjected to ordinary post-processing, such as dyeing, weight reduction, napping, water repellent processing, heat storage processing, or sweat absorption processing. In this case, the dye used for dyeing is not particularly limited and may be a disperse dye, a cationic dye, an acidic dye, or the like. However, cationic dyes require to select fibers that can be dyed with cationic dyes. Therefore, disperse dyes, which have higher versatility, are more suitable for use in dyeing. In addition, as a water repellent agent used for water repellent processing, known agents such as paraffin-based water repellent agents, polysiloxane-based water repellent treatment agents, fluorine-based water repellent treatment agents, and fluorine-free water repellent agents can be used, and the treatment may also be performed by a known method, such as a padding method or a spraying method.

The flap-equipped knitted fabric of the invention is movable upon wetting. In this case, it is preferable that the air permeability of the flap-equipped knitted fabric is anisotropic. That is, it is preferable that the air permeability from the back of the knitted fabric (the face opposite to the flap-side face) to the front of the knitted fabric (the flap-side face) and the air permeability from the front (the flap-side face) to the back (the face opposite to the flap-side face) are high. In addition, it is preferable that its air permeability and/or appearance changes when wet.

Such a flap-equipped knitted fabric is suitable for textile products such as garments (sportswear, outerwear, innerwear, men's clothing, women's clothing, medical clothing, nursing clothing, lining fabrics, summer kimono, workwear, protective clothing, etc.), footwear, hats, gloves, socks, masks, bedding, curtains, bedding covers, and chair covers.

Such a textile product uses the above flap-equipped knitted fabric, and thus flap parts are movable when wet (e.g., at the time of perspiration). This results in improved air permeability, whereby excellent wearing comfort is obtained. In addition, its appearance also changes.

EXAMPLES

Next, examples of the invention and comparative examples will be described in detail, but the invention is not limited thereto. Incidentally, measurement items were measured by the following methods.

(1) Crimp Degree

A yarn sample was wound around a skein frame under a tension of 0.044 cN/dtex to prepare a skein of about 3,300 dtex. Two loads of 0.0177 cN/dtex and 0.177 cN/dtex were applied to one end of the skein, and the length after 1 minute S0 (cm) was measured. Next, with the load of 0.177 cN/dtex being removed, the skein was treated in 100° C. boiling water for 20 minutes. After the boiling water treatment, the load of 0.0177 cN/dtex was removed, followed by natural drying in a free state for 24 hours, then loads of 0.0177 cN/dtex and 0.177 cN/dtex were applied again, and the length after 1 minute S1 (cm) was measured. Next, the load of 0.177 cN/dtex was removed, the length after 1 minute was measured as S2 (cm), and the crimp degree was calculated using the following mathematical expression. Incidentally, the measurement was performed ten times, and the average was taken.

$$\text{Crimp degree } (\%)=((S1-S2)/S0)\times 100$$

(2) Torque

A sample (crimped yarn) about 70 cm long was transversely tensioned. An initial load of 0.18 mN×displayed tex (2 mg/de) was hung in the center, and then both ends were put together.

The yarn, which started rotating due to residual torque, was left as it was until the initial load became stationary, whereby a twisted yarn was obtained. The number of twists per 25 cm of the twisted yarn thus obtained was measured under a load of 17.64 mN×displayed tex (0.2 g/de) using a twist counter. The obtained number of twists (T/25 cm) was multiplied by 4 to calculate the torque (T/m).

(3) Air Permeability

Air permeability ($cm^3/cm^2 \cdot s$) was measured in accordance with JIS L1096-2010 8.26.1 A-Method (Frazier Method).

Example 1

Polyethylene terephthalate was melt-spun from an ordinary spinning apparatus at 280° C., then taken up at a speed of 2,800 m/min, and wound up without stretching to give a semi-stretched polyethylene terephthalate yarn. Subsequently, using the polyethylene terephthalate yarn, a false-twist crimped yarn having a torque in the S-direction was formed by simultaneous stretching and false-twist crimping under the following conditions: draw ratio: 1.6, the number of false twists: 2,500 T/m (S-direction), heater temperature: 180° C., yarn speed: 350 m/min. Meanwhile, using the polyethylene terephthalate yarn, a false-twist crimped yarn having a torque in the Z-direction was formed by simultaneous stretching and false-twist crimping under the following conditions: draw ratio: 1.6, the number of false twists: 2,500 T/m (Z-direction), heater temperature: 180° C., yarn speed: 350 m/min. Next, the false-twist crimped yarn having a torque in the S-direction and the false-twist crimped yarn having a torque in the Z-direction were combined and interlaced (entangled) to give a composite yarn (44 dtex/48 fil, crimp degree: 16%, torque: 0 T/m) as a type-A yarn. Incidentally, the interlacing was performed using an interlacing nozzle at an overfeed rate of 1.0% and a pneumatic pressure of 0.3 M Pa (3 $kgf/cm^2$) to give 50 interlaces (entanglements) per m.

Meanwhile, Nylon 6 having an intrinsic viscosity [η] of 1.3 and a modified polyethylene terephthalate having an intrinsic viscosity [η] of 0.39 and copolymerized with 2.6 mol % of 5-sodium sulfoisophthalic acid were melted at 270° C. and 290° C., respectively, and formed into a side-by-side conjugate fiber, followed by cooling, solidification, and oil application. Subsequently, the yarn was preheated with a preheating roller at a speed of 1,000 m/min and a temperature of 60° C., then subjected to a stretching heat treatment between the preheating roller and a heating roller having a speed of 3,050 m/min and heated to a temperature of 150° C., and wound up to give a conjugate fiber having a fineness of 84 dtex/24 fil as a type-B yarn. The conjugate fiber had a breaking strength of 3.4 cN/dtex and a breaking elongation of 40%.

Next, a single circular-knitted fabric having the structure of FIG. 1 was knitted using a 28-gauge knitting machine, and then dyed blue with an acidic dye through an ordinary dyeing step including water-absorbing processing, thereby giving a flap-equipped knitted fabric including a ground structure part (G) and flap parts (P). In such a flap-equipped knitted fabric, as shown in FIG. 3, the flap parts were pouch-shaped, the type-A yarn (composite yarn) was disposed on the atmospheric side of the flap parts, and the type-B yarn (side-by-side conjugate fiber) was disposed on the ground structure side of the flap parts.

Next, the knitted fabric was immersed in water having a temperature of 20° C. for 2 hours and, immediately after that, sandwiched between a pair of filter papers to apply a pressure of 0.69 $mN/cm^2$ for 5 seconds. Water was then lightly wiped off, and the appearance was checked. As a result, as schematically shown in FIG. 4, the end portion of each flap part moved away from the ground structure part, giving changes in appearance.

In addition, the breathability (breathability in the direction from the front to the back) was measured before and after wetting. As a result, when wet, the air permeability increased by 67 $cm^3/cm^2 \cdot s$ as compared with before wetting.

Comparative Example 1

In Example 1, using only the type-A yarn, a single circular-knitted fabric having the structure of FIG. 2 was knitted using a 28-gauge knitting machine, and then dyed blue with a disperse dye through an ordinary dyeing step including water-absorbing processing, thereby giving a flap-equipped knitted fabric including a ground structure part (G) and flap parts (P).

Next, the knitted fabric was immersed in water at a temperature of 20° C. for 2 hours and, immediately after that, sandwiched between a pair of filter papers to apply a pressure of 0.69 $mN/cm^2$ for 5 seconds. Water was then lightly wiped off, and the appearance was checked. As a result, no changes in appearance were seen. In addition, the breathability (breathability in the direction from the front to the back) was measured before and after wetting. As a result, when wet, the air permeability decreased by 25 $cm^3/cm^2 \cdot s$ as compared with before wetting.

INDUSTRIAL APPLICABILITY

The invention provides a flap-equipped knitted fabric including a flap part, which is configured such that the flap part moves when wet, allowing for changes in the air permeability or appearance of the flap-equipped knitted fabric, and also a textile product, and the industrial value thereof is extremely high.

REFERENCE SIGNS LIST (P): Flap part
(G): Ground structure part
1: Atmospheric side of flap part
2: Ground structure part side of flap part

The invention claimed is:

1. A flap-equipped knitted fabric comprising a ground structure part and a flap part,
- wherein the flap part is movable upon wetting,
- and the flap part is pouch-shaped,
- and the flap part comprises an atmospheric side and a ground structure part side,
- and a conjugate fiber obtained by joining a polyester component and a polyamide component in a side-by-side manner or an eccentric sheath core manner is disposed on the ground structure part side of the flap part, and the atmospheric side of the flap part has a yarn configuration that is different from the ground structure part side of the flap part, and upon wetting, an end portion of the flap part moves away from the ground structure part.

2. The flap-equipped knitted fabric according to claim 1, wherein the flap part contains a false-twist crimped yarn.

3. The flap-equipped knitted fabric according to claim 2, wherein the false-twist crimped yarn is contained in the flap part as a constituent yarn of a composite yarn having a torque of 30 T/m or less.

4. The flap-equipped knitted fabric according to claim 2, wherein a false-twist crimped yarn having a torque in the S-direction and a false-twist crimped yarn having a torque in the Z-direction are alternately disposed.

5. The flap-equipped knitted fabric according to claim 1, wherein the flap part contains a water-repellent yarn.

6. The flap-equipped knitted fabric according to claim 1, wherein the flap-equipped knitted fabric is a circular-knitted fabric.

7. The flap-equipped knitted fabric according to claim 1, wherein the flap-equipped knitted fabric changes in air permeability and/or appearance when wet.

8. A textile product, which is selected from the group consisting of sportswear, outerwear, innerwear, men's clothing, women's clothing, medical clothing, nursing clothing, lining fabrics, summer kimono, workwear, protective clothing, footwear, hats, gloves, socks, masks, bedding, curtains, bedding covers, and chair covers, comprising the flap-equipped knitted fabric according to claim 1.

9. The flap-equipped knitted fabric according to claim 1, wherein the flap part contains a conjugate fiber obtained by joining a polyester component and a polyamide component in a side-by-side manner.

10. The flap-equipped knitted fabric according to claim 1, wherein the flap part contains a conjugate fiber obtained by joining a polyester component and a polyamide component in an eccentric sheath-core manner.

11. The flap equipped knitted fabric according to claim 1, wherein a composite yarn is disposed on the atmospheric side of the flap part, a yarn comprising the conjugate fiber is disposed on the ground structure part of the flap side, and the composite yarn is different from the yarn comprising the conjugate fiber.

* * * * *